United States Patent [19]

Bean

[11] 4,144,061

[45] Mar. 13, 1979

[54] TRANSFER DEVELOPMENT USING A FLUID SPACED DONOR MEMBER

[75] Inventor: Lloyd F. Bean, Rochester, N.Y.

[73] Assignee: Xerox Corporation, Stamford, Conn.

[21] Appl. No.: 810,224

[22] Filed: Jun. 27, 1977

[51] Int. Cl.[2] ..... G03G 13/08; G03G 15/08

[52] U.S. Cl. ..... 96/1 SD; 427/14; 118/653

[58] Field of Search ..... 118/655, 653, 644, 654, 118/647, 650, 661; 427/14; 96/1 SD

[56] References Cited

U.S. PATENT DOCUMENTS

| | | | |
|---|---|---|---|
| 3,273,496 | 9/1966 | Melmon | 118/650 X |
| 3,654,900 | 4/1972 | Yang | 118/650 |
| 3,828,670 | 8/1974 | Kennedy | 118/647 X |
| 3,878,817 | 4/1975 | Kuehnle | 118/647 |
| 3,890,929 | 6/1975 | Walkup | 118/653 |

*Primary Examiner*—Werner H. Schroeder
*Assistant Examiner*—Andrew M. Falik
*Attorney, Agent, or Firm*—James J. Ralabate; Clarence S. Green; William A. Henry, II

[57] ABSTRACT

Fluid spaced transfer development of electrostatic images is achieved by using a developer donor, the surface of which has perforations that permit the passage of fluid pressure therethrough. The fluid pressure impinges against an imaging surface in order to maintain a uniform spaced relationship between the donor and the imaging surface.

4 Claims, 4 Drawing Figures

TRANSFER DEVELOPMENT USING A FLUID SPACED DONOR MEMBER

BACKGROUND OF THE INVENTION

The present invention is related to xerographic copying systems and, more particularly, to systems which employ what is known as "transfer" or "touchdown" development.

The xerographic process as disclosed in U.S. Pat. No. 2,297,691, encompasses a xerographic plate comprising a layer of photoconductive insulating material on a conductive backing. This plate is provided with a uniform electric charge over its surface and is then light exposed to the subject matter to be reproduced. A light exposure discharges the plate areas in accordance with the radiation intensity that reaches it and thereby creates a latent electrostatically charged image on or in the photoconductive layer. Development of the latent image is effected with an electrostatically charged, finely divided material such as an electroscopic powder, that is brought into surface contact with the photoconductive layer and is held thereon electrostatically in a selected pattern corresponding to the latent electrostatic image. Thereafter, the developed image may be fixed by any suitable means to the surface on which it has been developed or the developed image may be transferred to a secondary support surface to which it may be fixed or utilized by means known in the art.

Once the electrostatic latent image is formed, the method by which it is made visible is the developing process. Various developing systems are well known in the art and include cascade, brush development, magnetic brush, powder cloud and liquid development. Still another developing method is disclosed in U.S. Pat. No. 2,895,847 to Mayo in which a developing support member, called a "donor," is employed to present a releasable layer of electroscopic (toner) particles to a photoconductive layer for deposit thereon in conformity with an electrostatic latent image. The Mayo approach is one of several variations which involve the transfer of toner particles from a donor to the photoconductive surface and is therefore called transfer development. This technique is also known as "touchdown development."

The three principal variations of transfer development include (1) an arrangement in which the layer of toner on the donor surface is held out of contact with the electrostatically imaged photoconductor and the toner must traverse an air gap to effect development; (2) an arrangement in which the toner layer on the donor is brought into rolling contact with the imaged photoconductor; and (3) an arrangement in which the toner layer is brought into contact with the imaged photoconductor and skidded across the imaged surface to effect development.

In the first of the above arrangements, when the toner and photoconductor surface are maintained out of contact, a layer of toner particles is applied to a donor member which is capable of retaining the particles on its surface and then the donor member is brought into close proximity to the surface of the photoconductor. In this closely spaced position, particles of toner in the toner layer on the donor member are attracted to the photoconductor by the electrostatic charge on the photoconductor so that development can occur. Typically, the spacing between a donor, and a photoconductor is between one and ten mils. This arrangement is referred to as "spaced touchdown development."

In "touchdown development," a variety of donors is possible and known in the art. A donor member may be constructed of a variety of materials which include paper, plastic, cloth, metal, aluminum foil or metal-backed paper. Stephen in U.S. Pat. No. 4,011,834, which is incorporated herein by reference discloses a touchdown development apparatus that employs "boat" shaped elements for self-spacing a donor member from an image bearing member.

In U.S. Pat. No. 3,203,294 to Hope et al various donors are described which employ the principle of using a set of conductive posts or a conductive screen which is charged with the same polarity and selective amount as the charged toner particles. Accordingly, as the donor member is brought into contact with the toner particles, those areas adjacent to the posts or screen will electrostatically repel the toner, thereby forcing the toner away from those portions. The remaining areas of the donor member are charged to attract the toner particles when the particles are accumulated there. As described in the Hope et al patent, the donor member of this type of construction gives better mobility to the toner particles so as to yield sharper xerographic copies.

In U.S. Pat. No. 3,375,806 to Nost, the donor member is described as being either electrically insulated or conductive and may comprise such materials as metal sheets, conductive rubbers, Mylar or the like.

Although spaced touchdown may be used for a variety of donors as described above, certain problems exist with this approach. One of the problems of the spaced donor arrangement is the difficulty of maintaining the aforementioned spaced relationship between the donor surface and the photoconductor surface. Additionally, in all transfer development systems, uniform deposition of toner onto the donor, which is a requirement for high quality prints, has been difficult to achieve because of the tendency of toner to clump and because of the internal electrostatic forces among the toner particles.

One approach for obviating the above problems has been the use of a donor member having a surface with raised and depressed portions, such as a gravure surface with an elevated grid network enclosing a plurality of depressed cups, as disclosed in Greig, U.S. Pat. No. 2,811,465. If such a donor member were used in contact with the imaging surface and doctored such that toner resided only in the cups, theoretically the toner would not contact the background, or uncharged, areas of the imaging surface. That is, the uniform gap between the toner and the image could be maintained by having the raised areas of the donor and the only point of contact on the imaging surface. Toner would, of course, still be attracted from the depressed portions of the donor to the charged image areas, with the need for complicated gap-controlling means eliminated. Additionally, the roughened surface would tend to break up clumps of toner during the loading step.

However, in practice, although such a donor member produced somewhat improved transfer development, it was found that toner could not be efficiently loaded on the donor without at least partially covering the raised grid structure of toner. Thus, toner would still contact the background areas of the imaging surface, thereby producing some background deposition in the copy. Also, the images produced bore the impression of the grid structure due to interference of the grid with complete toner deposition of the charged areas. Clearly, both the above results are undesirable in a high-quality imaging process.

SUMMARY OF THE INVENTION

It is accordingly an object of the present invention to provide an electrostatographic copying method and apparatus for touchdown development that promotes improved uniform spacing between the donor surface and the imaging surface.

It is a further object of the present invention to provide a means whereby spacing between the photoreceptor and a donor member can be varied.

Yet another object of the present invention is to provide a means whereby relative motion between a photoconductor and the donor member can occur without wear and/or damage occurring to the photoconductor or donor.

Yet another object of the present invention is to provide an improved donor member that allows additional toner to be supplied through perforations in the donor surface, if needed.

The above objects and other advantages are realized by providing, in a xerographic transfer development apparatus, for example, a developer donor member having perforations in the surface thereof that permit the passage of fluid pressure therethrough from a pressure source in order to maintain a uniform spaced relationship between the donor and an imaging surface.

DETAILED DESCRIPTION OF THE INVENTION

Figure 1:
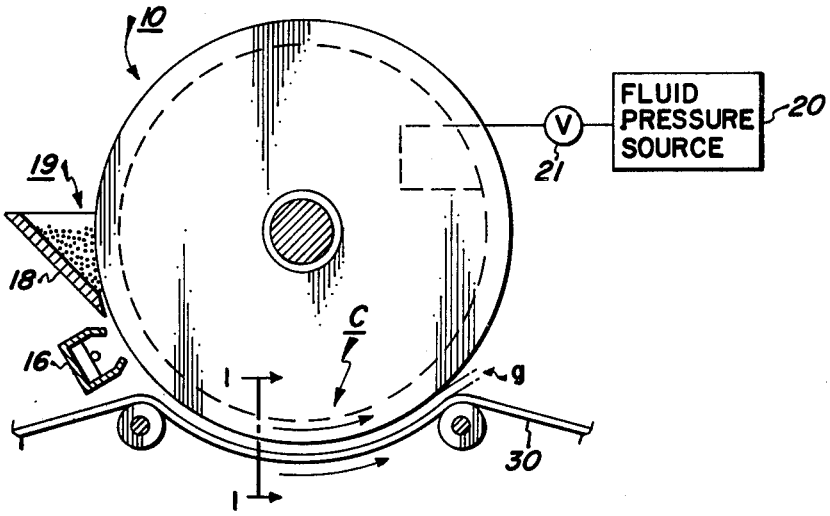
FIG. 1 illustrates schematically a partial and simplified form of a spaced touchdown xerographic system.

Referring initially to FIG. 1, a partial xerographic reproduction system compatible with the present invention is shown.

This system comprises a xerographic photoconductive plate in the form of a belt 30. The belt is driven by conventional means which rotates the belt surface through stations not shown in the figure since they are conventional. The belt 30 has a suitable photosensitive surface, which may, for example, include selenium overlying a layer of conductive material, upon which a latent electrostatic image can be formed. The various conventional stations about the periphery of the belt 30 include a charging station, exposing station, developing station C, transfer station and a cleaning station. At the charging station, a suitable charging means, such as a corotron, places a uniform electrostatic charge on the photoconductor surface. As the belt 30 rotates, the charged area is brought to an exposure station which supplies the light image to be reproduced. A latent electrostatic image is thus formed on the surface of the belt. This image is then developed at station C by the application of a finely divided, pigmented, resinous, electroscopic powder called toner. The developed image then passes through a transfer station where the image on the photoconductor is transferred to a copy substrate with the copy substrate then being forwarded to a fusing station where the image is fused to the copy substrate. The cleaning station then performs the function of cleaning the surface such as with the use of a brush or any other suitable conventional device.

Referring particularly to the developing station C of FIG. 1, a donor member 10 is shown which is preferably rotatable by conventional means (not shown) in the direction indicated. Adjacent donor member 10 is a toner reservoir 19 containing toner particles. The donor member or roll 10 is positioned so that a portion of its periphery comes into contact with toner in reservoir 19. Also located around the donor roll 10 is a charging means 16. Charging means 16, which may be a corona charging device, is adapted to place a uniform charge on the toner particles of a polarity opposite to the polarity of the latent image on the photoconductive drum.

In this arrangement, the surface of donor member 10 is spaced a small gap "g" from the photoconductor as shown in FIG. 1 which can be approximately one to several mils. This gap may be filled or partially filled with electroscopic toner particles. In accordance with the present invention, this gap is maintained in a fluid spacing manner as described below.

Figure 3:
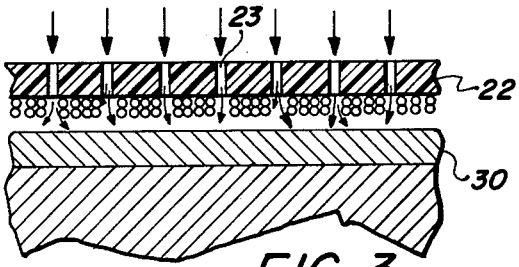
FIG. 3 shows a partial cross section of FIG. 1 taken along line 1—1.

In FIG. 3, a partial cross-section of FIG. 1 is shown comprising a donor member surface 22 with perforations 23 in the surface thereof for controlling the space between the photoreceptor 30 and the donor 10. Fluid pressure from source 20 that is regulated by control means 21 is supplied through the perforations 23 in donor surface 22 against photoconductor surface 30 to maintain a uniform space between the two surfaces. Fluid introducing holds 23 are located in such a manner that toner deficient areas, e.g. strobe lines and/or dots are minimized. The rotational speeds of the donor 10 and the photoconductive member 30 are preferably not identical. The donor speed is preferably slower than the speed of the photoconductor for reduced background. A donor speed greater than the photoconductor speed would make for increased image density. Appropriate seal and/or vacuum pickup of excess toner to prevent contamination of the copier interior would naturally be included in the apparatus of this invention.

While the invention is described in a dry development environment, it should be understood that it could be used with liquid development also. Liquid development would require the use of a toner suspended in an insulating fluid. Liquid could be used instead of air in a liquid development system as the spacing medium.

Figure 2:
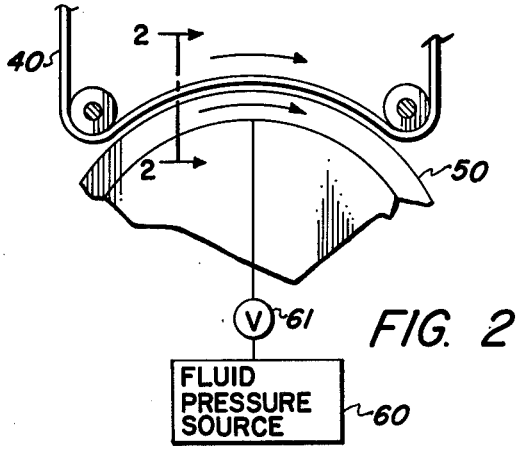
FIG. 2 is a partial schematic of a simplified second embodiment of the present invention.
Figure 4:
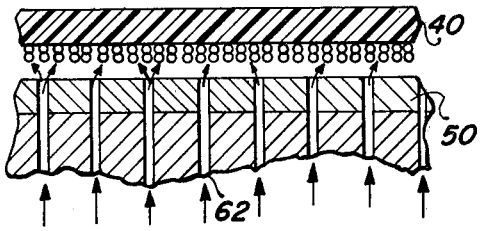
FIG. 4 is a partial cross section taken along line 2—2 as shown in FIG. 2.

FIG. 2 shows another embodiment of the present invention in which the donor member is in the form of a belt 40 and the photoconductor member is in the form of a drum 50. In this embodiment, fluid pressure is supplied from a source 60 through control means 61 and out through perforations 62 in the surface of the photoconductive drum 50 as shown in FIG. 4 in order to maintain uniform spacing between the photoconductor member 50 and the donor member 40. It should be understood that both the donor member and the photoconductive member could be in the shape of drums if one so desired.

A doctor blade 18 as shown in FIG. 1 may be made from a rigid or semi-rigid material such as steel, plastic, or a vulcanized elastomer. This doctor blade is used to distribute toner from a toner supply 19 onto the surface of donor member 22. The doctor blade may be positioned in any suitable fashion at the points of contact with the toner material, however, it is preferred that the blade tip be beveled parallel to the donor surface.

The image development method of this invention is useful in any electrophotographic reproduction system.

The donor shape may be any configuration which permits fluid-spaced contact with the imaging surface. The imaging surface may be comprised of any suitable material capable of retaining an electrostatic image-wise charge, such as photoconductive insulating materials, dielectrics, and combinations thereof. The electrostatic latent image may be formed directly on the photoconductive material, or by induction on, or transferred to a dielectric film.

The donor surface 22 can be electrically biased during development. Therefore, where this is to be the case, the surface member 22 of FIG. 1 should be a conductive material or a dielectric material with a conductive backing.

The donor developer material may be of any commonly known particulate powders capable of rendering visible and being attracted to an electrostatic latent image, such as xerographic toners. The toner must be electrically charged opposite the charge comprising the latent image for charge area development or the toner must be charged to the same polarity as the photoconductor where development of discharge areas occurs. In this case, the bias of the toner is approximately equal to the bias of the photoconductor surface potential in "dark" areas. Toner charging preferably takes place after the toner has been deposited onto the donor.

In conclusion, an apparatus and method is disclosed for fluid spacing a donor member in relation to a photoconductive member that comprises a fluid pressure source for supplying fluid through perforations in the surface of the donor member against the adjacent photoconductive surface in order to space the donor therefrom. A control means is disclosed for varying the gap or spacing between the photoconductor surface and the donor.

In addition to the method and apparatus disclosed above, other modifications and/or additions will readily appear to those skilled in the art upon reading this disclosure and are intended to be encompassed within the invention disclosed and claimed herein.

What is claimed is:

1. In an electrostatographic imaging process, which comprises forming an electrostatic latent image on an imaging surface, distributing toner material on the surface of a donor member, and developing said image by electrostatically transferring the toner material to said image from the surface of the donor member maintained in close proximity to the imaging surface:

the improvement comprising maintaining the donor member surface at a uniform spaced relationship to the imaging surface by applying fluid pressure through perforations in the donor member against the imaging surface.

2. In an electrostatographic imaging process, which comprises, forming an electrostatic latent image on an imaging surface, distributing toner material on the surface of a donor member, and developing said image by electrostatically transferring the toner material to said image from the surface of the donor member maintained in close proximity to the imaging surface:

the improvement wherein the donor member surface is maintained at a uniform spaced relationship to the imaging surface by providing fluid pressure through perforations in the imaging surface against the donor member surface.

3. In an electrostatographic imaging apparatus, comprising, an imaging member with a surface capable of retaining an electrostatic latent image, a donor member with a surface capable of supporting a layer of particulate image developing material, and means for spacing said imaging member from said donor member;

the improvement wherein said means for spacing said imaging member from said donor member includes perforations in said imaging member surface and a fluid pressure source for applying fluid pressure through the perforation and against said donor member.

4. The improvement of claim 3 including means for varying the spacing between said imaging member and said donor member.

* * * * *